US005743220A

United States Patent [19]

Guarner-Lans

[11] Patent Number: 5,743,220

[45] Date of Patent: Apr. 28, 1998

[54] INTERNAL COMBUSTION ENGINE WITH CENTRAL CHAMBER

[76] Inventor: Enrique Eduardo Guarner-Lans, Periferico Sur 3840-301, Col. Pedregal de San Angel, Mexico, 01900

[21] Appl. No.: 681,850

[22] Filed: Jul. 29, 1996

[51] Int. Cl.[6] ..... F02B 75/26

[52] U.S. Cl. ..... 123/56.9

[58] Field of Search ..... 123/56.9, 56.1, 123/56.2, 56.3

[56] References Cited

U.S. PATENT DOCUMENTS

| | | | |
|---|---|---|---|
| 1,065,604 | 6/1913 | Gray | 123/56.9 |
| 1,796,453 | 3/1931 | Goehler | 123/56.9 |
| 1,808,083 | 6/1931 | Tibbets | 123/56.9 |
| 1,976,286 | 10/1934 | Kreidler | 123/56.9 |
| 2,664,866 | 1/1954 | Fulke | 123/56.9 |
| 3,396,709 | 8/1968 | Robicheaux | 123/56.9 |
| 5,031,581 | 7/1991 | Powell | 123/56.9 |
| 5,507,253 | 4/1996 | Lowi, Jr. | 123/56.9 |

OTHER PUBLICATIONS

Physics Today article "Thermodynamics in finite time" by Andresen, Salamon & Berry; Sep. 1984; pp. 62–70.

*Primary Examiner*—David A. Okonsky

*Attorney, Agent, or Firm*—Locke Purnell Rain Harrell

[57] ABSTRACT

The present invention relates to a central combustion chamber engine consisting of an assembly formed by pistons that move from ends opposed to a combustion chamber, in which said chamber has intake and exhaust control means for the combustion gases (valves), ignition means or spark plug to induce the combustion of said gases and movement transmission means from the pistons activated by the expansion of the combustion gases in compression ratios similar to the ones of conventional internal combustion engines, towards the main engine shaft, which is located longitudinally along the same motor assembly, and rotates using sliding means, and achieving thus better operation performance, because it uses optimal pathways of the finite-time thermodynamic cycle, balance of the running engine and total symmetry with respect to the ignition point which will favor a more complete fuel combustion.

10 Claims, 3 Drawing Sheets

INTERNAL COMBUSTION ENGINE WITH CENTRAL CHAMBER

TECHNICAL FIELD OF THE INVENTION

The present invention relates to the metal mechanic industry with regard to rotary equipment's for the generation of movement through burning of fuel, said equipment's are primarily used in the transport industry. It is an internal combustion engine of the so-called central combustion chamber type or motor, which consists of a group of pistons axially opposed that move from the central combustion chamber outwards, where sliding means are mounted on radial guides or flanges that follow an optimum finite-time thermodynamics path of the Otto cycle, and through which the movement of the main shaft or axle of the engine is generated.

BACKGROUND OF THE INVENTION

Since the invention of the motor and movement systems based on the steam engines up to now, the engines have evolved greatly, specially with regard to their applications, designs and devices that make their functioning more efficient and longer lasting.

Various movement induction means have been applied, according to the purpose and the use of the engine or the conditions of space, access to said movement means as well as its objectives. Thus, engines have been developed based on the non-direct use of fuel using several sources of energy, such as electricity, wind, water and steam, among others.

Even though the use of engines as the ones above mentioned that do not make use of fuel directly has been successful, such as in the case of electric motors, the use of internal combustion engines (with direct use of fuel) has developed to a great extent, because of the characteristics that make them specially suited for transportation vehicles such as cars, trucks, tractors and other systems such as electric and pump substations, among others.

With regard to the internal combustion engines that work according to the so-called Otto cycle, their use has developed to a great extent, mainly in the automobile and transportation industry, and has provoked the development of one of the largest and most important industries of the world.

Based on the traditional principles of mentioned cycle, which include the intake, compression, power and exhaust strokes, the innovations and improvements carried out on internal combustion engines have lead to the search for higher efficiencies and yield. The motivations behind the exploration of said changes are essentially related to the increase in fuel prices, and lately, to the need to reduce the emission of polluting gases because of environment protection regulations.

There have been many inventions, the object of which has been to improve the yields and uses of engines, and there have even been radical proposals to greatly modify the traditional concepts on which engines are based. This continuous effort by companies and inventors can be observed through the large amount of patent documents that are being published every year in this field, as well as other related studies.

Bjarne Andresen, Peter Salamon and R. Stephen Berry theoretically optimized the Otto cycle of an internal combustion engine in its intake, compression, power and exhaust strokes, defining the speed and position of the piston for the complete cycle, to yield the maximum work per cycle. In this optimized cycle the strokes do not have the same extension and are not symmetrical, but the question to build an engine that follows optimized path was not answer. See the attached article by Andresen, Salmon and Berry, entitled "Thermodynamics in finite time" published beginning on page 62 in September 1984 PHYSICS TODAY by the American Institute of Physics, which is incorporated herein by reference.

In a more practical field, other alternatives have been directed towards the creation of alternative motor systems, such as the ones based on rotary mechanisms such as the so-called Wankel motor, among others. Several of said mechanisms have reached the operative phases on the market, such as the Wankel engine manufactured by Mazda. However its commercial success has not been all together satisfactory, and the company has continued offering the conventional engine concepts.

In most of the cases, the decisions based on an economic point of view, identifying the high costs related to the transition of a gigantic sector of an industry, such as the automobile industry, towards some of these radical innovations, have not permitted a full analysis of the technical proposals such as the above-mentioned ones. Basic modifications are necessarily required in various concepts of related industries, and this has made the decision making process difficult.

Thus, only gradual innovations have been proposed with regard to the pistons, cams, shafts and valves, in order to improve the performance, the operation efficiencies and to fulfill various environmental restrictions. Because of this, the resulting engine has become more sophisticated.

None of these proposals has been really transcendental with regard to giving the engine its optimal efficiency and simplifying elements.

Despite what has been said, the applicant, according to the present invention, has created an alternative engine based on the path optimization proposed by the finite-time thermodynamics theory. It is a technical alternative that additionally takes special care of aspects such as simplicity, reliability and economy, that can be decisive in the modification of the conventional engines, presently used by most of the automobile manufacturers in the transportation sector.

In this sense, the applicant has proposed the present invention based on what shall be called hereinafter a central combustion chamber motor (CCCM) with a structural configuration which is different from all the previously proposed uses of the four-stroke piston. It is characterized because it makes a different use of pistons and valves, without abandoning these elements, permitting low complexity and construction costs. This allows to achieve efficiency improvements in the performance of said engine as well as an important reduction in manufacturing and installation costs, using the present technological bases in the industry compared to the manufacturing costs of turbines and other types of rotary systems.

Some of the large number of patents that have been granted, have offered proposals or alternatives of engine arrangements, modificating the main structure. Thus, for example, the U.S. Pat. No. 4,887,558 owned by the French company Aeroespaciale Societe Nationale, shows the proposal of an internal combustion engine concept with annular opposed pistons and a main or central shaft. This engine tries to make use of the opposed piston concept, which moves inwardly with regard to the engine during the expansion stroke, transmitting the movement towards a guide assembly located in the central part of the engine. It is to be observed that this embodiment offers new alternatives of efficiency and dynamic balance of the functioning engine, however, the complexity of the combustion chambers as well as the excessive concentration of the power transferred from the pistons to the guides, make it evident that its operation presents serious drawbacks. U.S. Pat. No. 4,887,558 is in its entirety incorporated by reference herein.

The applicant of the present invention has proposed to combine the opposed piston concept with central combustion chamber, where the movement transmission power is carefully controlled to remain within the optimum path of the Otto cycle.

The central combustion chamber motor (CCCM) of the present invention includes thus an assembly formed by pistons that come from opposed ends towards the combustion chambers, in which said chambers have intake and exhaust control means (valves) for the combustion gases; ignition means or spark plugs to induce the combustion of said gases, and movement transmission means from the pistons activated by the ignition of the combustion gases towards the main engine shaft, which is positioned longitudinally along the same engine assembly, using sliding means for this purpose, and achieving thus improved operation performance, balance of the functioning engine and a more complete combustion of the fuel used.

It is thus an object of the present invention to offer an internal combustion engine with central combustion chamber of simple design, with simplified components to achieve a competitiveness both with regard to its functioning and its manufacturing.

Another object of the present invention is to offer an internal combustion engine with central combustion chamber that follows the optimization pathway of the Otto cycle in order to achieve a higher power and efficiency with regard to the use of fuel.

A further object of the present invention is to offer an internal combustion engine with central combustion chamber susceptible of following optimum pathways of the diesel cycles.

A further object of the present invention is to offer a central combustion chamber engine embodiment the total number of parts of which is reduced, compared to the conventional configurations of the known internal combustion engines.

A further object of the present invention is to offer an internal combustion engine with a central combustion chamber, with symmetry characteristics such that they promote the complete combustion of the fuel used.

A further object of the present invention is to propose a central combustion chamber engine which, because of the design characteristics of said combustion chambers and because of its gas expansion work, presents such performance attributes to make better use the thermal energy produced by the expanding gases, and thus the use of the cooling systems can be considerably simplified compared to conventional engines.

A further object of the present invention is to offer a system which, besides adequately functioning as a central combustion chamber engine, can be, because of its physical and structural configuration, functionally modified in order to be used as compressor and air engine.

These and other characteristics of the present invention, with its various alternatives and embodiments that make it highly advantageous compared to the conventional technologies, can be better appreciated and with greater details in the following section of the present description.

DETAILED DESCRIPTION OF THE INVENTION

Figure 1:
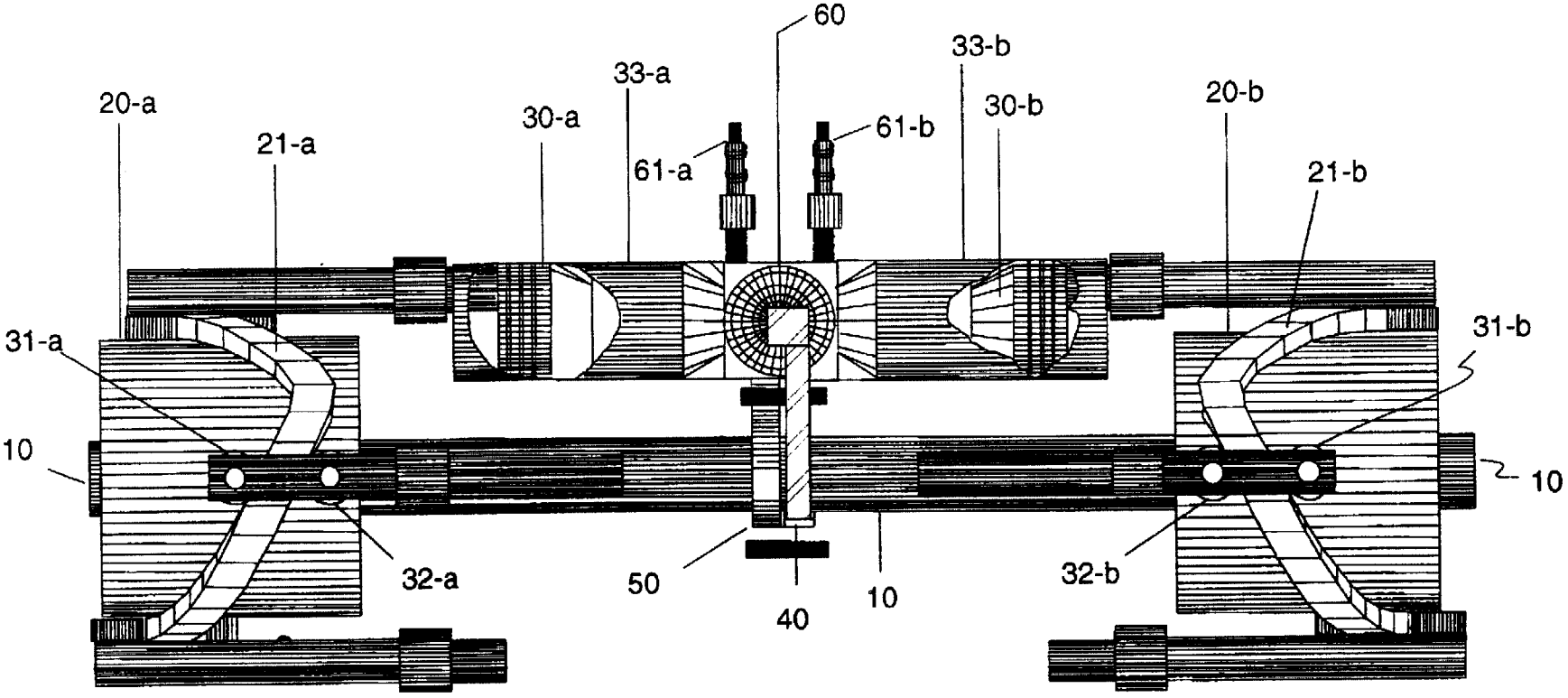
FIG. 1 shows a front partial view of the central combustion chamber motor (CCCM) in a preferred arrangement or embodiment of said engine according to the present invention, where the assemblies that constitute it are partially presented.

According to the aspects that are shown in an illustrative but not limitative way in the drawings, and according to what is shown in FIG. 1, the present invention consists of an internal combustion engine, specially of optimized pathway of the Otto cycle, which is constituted by an assembly formed by a main axle (10), which is also the main shaft, to which are connected in its longitudinal ends, circular means containing radial guides or flanges that can be of a low or high relief, (21-*a*) and (21-*b*), while there is an assembly of central combustion chambers in its intermediate section. One of such assemblies of central combustion chambers is represented.

It is worth noting that in said FIG. 1 we can observe a partial lateral section of the central combustion chamber engine of the present invention, to which some representation arrangements have been made, in order to better appreciate the constitutive parts of the invention. As has already been mentioned, the assembly includes in each one of its two extreme longitudinal circular supports means (20-*a*) and (20-*b*) having radial guide or flange (CRG), on which the corresponding flanges or radial guides (21-*a*) and (21-*b*) are superficially distributed, internally or externally on such support.

In a typical embodiment of one representative central combustion chambers assembly, the opposed assemblies of pistons or opposed pistons (30-*a*) and (30-*b*) are moved by the expansion action of the combustion gases in the expansion chambers (33-*a*) and (33-*b*), transmitting the force to the radial guides or flanges (21-*a*) and (21-*b*) though the corresponding sliding means (31-*a*), (32-*a*), (31-*b*) and (32-*b*), which are located in the distant end of each of the piston assembly, conveniently connected to said assemblies. In this way, through the activation of the opposed expansion force in each one of the opposed pistons (30-*a*) and (30-*b*), the force acts towards the sliding means mounted on the radial flanges located in the circular supports (20-*a*) and (20-*b*) in such a way that it produces a rotary movement of said circular supports, which are fixed to the axle or main shaft of the engine, through which the movement is generated.

Each one of the piston assemblies (30-*a*) and (30-*b*), are located in sealed expansion housings, chambers or cylinders (33-*a*) and (33-*b*), using any lubrication and sealing means for the expansion gases and with the shape such as the ones conventionally known in the art, where such pistons start in an opposed axial movement from one of the so-called central combustion chamber (400) in which ignition means or spark plugs (61-*a*) and (61-*b*) are located, housed in the available spaces of said chamber. The sliding means (31-*a*), (31-*b*), (32-*a*) and (32-*b*) located in the distal ends of the piston connection, can be ball bearings, conventional type bearings or any other system that permits the sliding connection and the continuous contact with the radial guide or flange, where said guides or flanges can be of the high or low relief types, internally or externally mounted on the circular support.

As can be deduced, one of the most important parts of the central combustion chamber motor (CCCM) of the present invention is the so-called radial guide or flange (21-*a*) and (21-*b*), by means of which the pistons carry out the force through which the engine shaft (10) rotates.

The amplitude and width of the path of the radial guides or flanges and the number of said guides or flanges on which the sliding means for the piston movement transmission moves, follow the pathway according to the finite-time thermodynamics concepts.

It was found that the piston that follows this pathway in a four-stroke engine increases to a large extent both combustion and efficiency. Some of the tests carried out with the model of this invention have shown a 15% efficiency increase of the Otto cycle. However, and according to the same inventive concept, it is possible use other paths, based on the thermodynamic principles or other types of principles that could be derived from the state of the art. This happens, among various reasons, because the expansion force is rapidly applied before hot combustion gases cool on the cylinder walls and reducing the friction in the remaining three strokes through constant speed.

The engine must be built according to adequate geometric proportions in such a way that it offers a continuous oscillatory movement without variations that are negative on the functioning of said engine at high revolutions. The proposed configuration favors this because of its symmetry and balance.

The applicant has found that the optimum dimensions of said radial guide or flange must be such that they withstand the maximum force applied by the piston without breaking or being damaged, depending on the construction material. The width of the flange is variable and proportional to the slope of the path in order to permit the continuous rolling of the sliding means without their losing contact with said flanges or radial guides. Moreover, more than one radial guide or flange in high or low relief can be conveniently built according to the restrictions regarding the materials employed in the construction of the elements.

Figure 2:
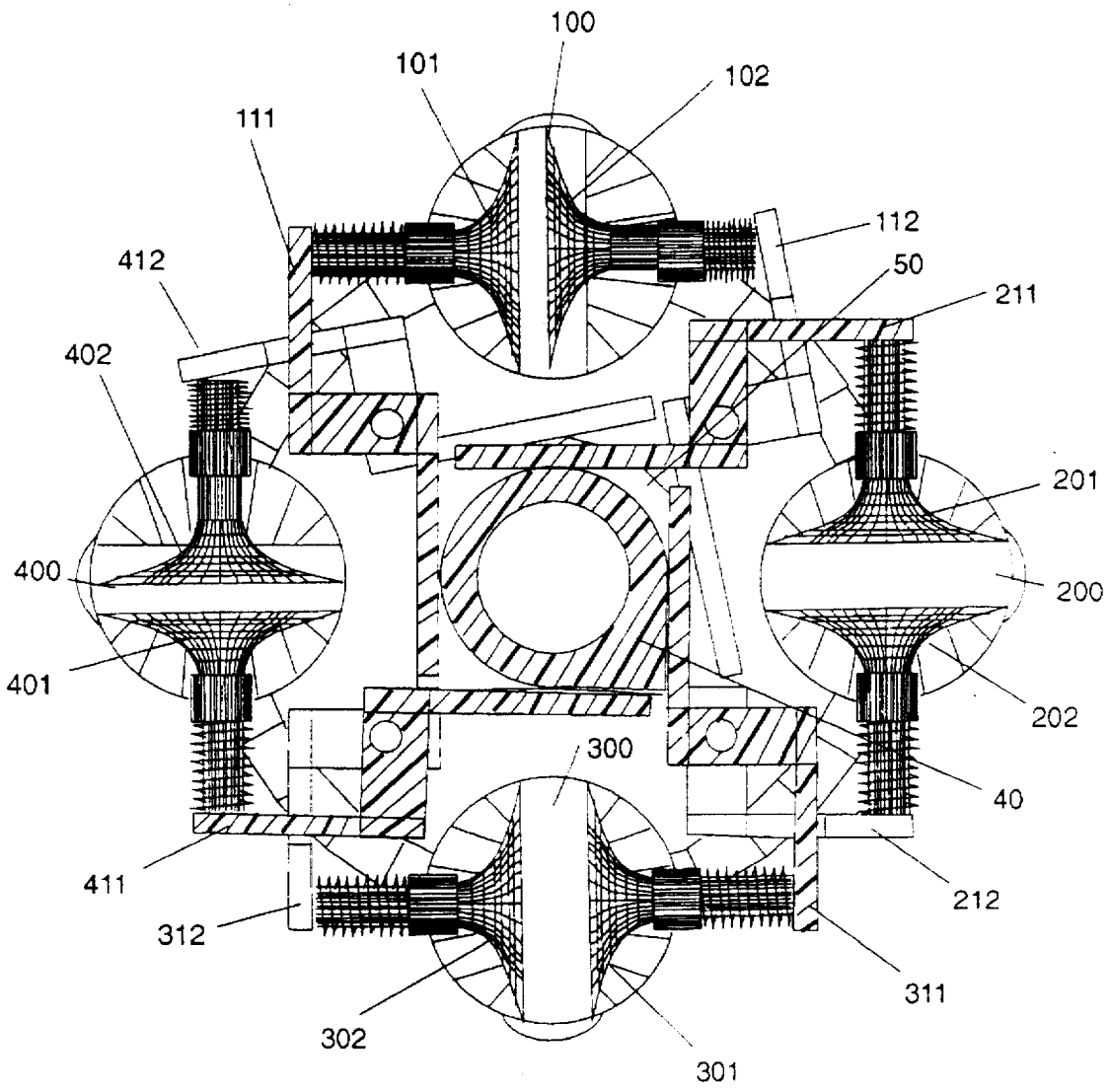
FIG. 2 is a partial cut view of the central combustion chamber motor (CCCM) of the present invention, showing the valve positions with regard to a four combustion chamber embodiment and the arrangement of the levers or movement transmission means of the same, in one of the positions of said engine, determined by an optimal path.

FIG. 2 shows the way the valves operate in each of the central combustion chambers. Accordingly, when the main shaft (10) is moved by the action of the pistons, it operates directly against the cam assembly (40) and (50), that are the respective means of movement activation of the intake and exhaust valve assemblies, through its respective movement transmission means from the cams to the valves.

This FIG. 2 also shows the position of the valves, cam and lever assemblies in an engine embodiment with four combustion chambers in which said valves, cams and levers permit the functioning of the central combustion chamber engine. According to this graphic representation, in the center of this engine assembly there is the main shaft (10), around which there are two cams (40) and (50), that are the main movement transmission means for the activation of the synchronization means of the intake and exhaust valve assemblies, respectively.

Said valves assemblies are configured in pairs that correspond to the combustion chambers (100, 200, 300 and 400), and to each one of said chambers there correspond an intake valve (102, 202, 302 and 402) and an exhaust valve (101, 201, 301 and 401) respectively. One of the embodiments presented in said FIG. 2 includes an assembly of movement transmission means connected to each one of said intake and exhaust valves, in such a way that for the combustion chamber (100), its corresponding intake valve (102) is connected to a movement transmission means or lever (112) which transmits said opening or closing movement of said intake valve (102) from the intake cam (50), while the corresponding exhaust valve (101) is connected to a movement transmission means or lever (111) which transmits said opening or closing movement of said exhaust valve (101) from the exhaust cam (40).

With regard to the combustion chamber (200), its corresponding intake valve (202) is connected to a movement transmission means or lever (212) which transmits said opening or closing movement of said intake valve (202) from the intake cam (50), while the corresponding exhaust valve (201) is connected to a movement transmission means or lever (211) which transmits said opening or closing movement of said exhaust valve (201) from the exhaust cam (40).

In the same way, with regard to the combustion chamber (300) its corresponding intake valve (302) is connected to a movement transmission means or lever (312) which transmits said opening or closing movement of said intake valve (302) from the intake cam (50), while the corresponding exhaust valve (301) is connected to a movement transmission means or lever (311) which transmits said opening or closing movement of said exhaust valve (301) from the exhaust cam (40).

In the same way, with regard to the combustion chamber (400) its corresponding intake valve (402) is connected to a movement transmission means or lever (412) which transmits said opening or closing movement of said intake valve (402) from the intake cam (50), while the corresponding exhaust valve (401) is connected to a movement transmission means or lever (411) which transmits said opening or closing movement of said exhaust valve (401) from the exhaust cam (40).

FIG. 2 also shows in its entirety one of the positions in which the cycle of the engine operates. According to this representation, it can be observed that in the chamber (400) the intake process is initiated through the opening of the corresponding valve (402), while simultaneously in said chamber the exhaust finalization process is carried out with the closing of the corresponding exhaust valve (401). Simultaneously, in the combustion chamber (100), the intake is ending, with the corresponding intake valve (102) in the opened position and the corresponding exhaust valve (101) in the closed position.

At the same time, the combustion chamber (200) shows an end of compression position, with both the intake valve (202) and the exhaust valve (201) in fully closed position. Finally, and with regard to the combustion chamber (300), the position of the valves in expansion and at the beginning of the exhaust process is shown.

It is important to note that the optimal thermodynamic selected path for this description has the intake stroke longer than the other three strokes, so that two chambers can have the intake valves (102 and 402) opened simultaneously in such a way that this does not occur in a motor with the conventional configuration and near sinusoidal path.

It is worth noting that the simplicity, novelty and inventive value of the mentioned valves mechanism, compared to the traditional mechanism of camshafts with a shaft ratio of 2:1, offers important advantages with regard to the functioning of the engine.

The CRG cylinder receives four impulses of approximately sixty six degrees in sequence for every cycle of the main shaft of the engine.

The above mentioned pathway does not have the four strokes equal in length and has the following characteristics: in the expansion cycle it permits a fast expansion which is the nearest possible to one of the adiabatic characteristics in such a way that most of the energy is transformed in the gas expansion and that the losses on the cylinder walls are reduced; in the exhaust cycle, it follows a straight path in order to minimize the losses caused by friction; the intake cycle is also straight, but longer than the exhaust cycle in order to permit the total filling of the chamber before the closing of the intake valve; finally, the compression cycle also follows a straight path in order to minimize the losses caused by friction. Contrary to the traditional configuration engines in which the piston is forced to follow a nearly sinusoidal path without taking into account the losses caused by heat or the optimization of each stroke of the cycle.

Figure 3:
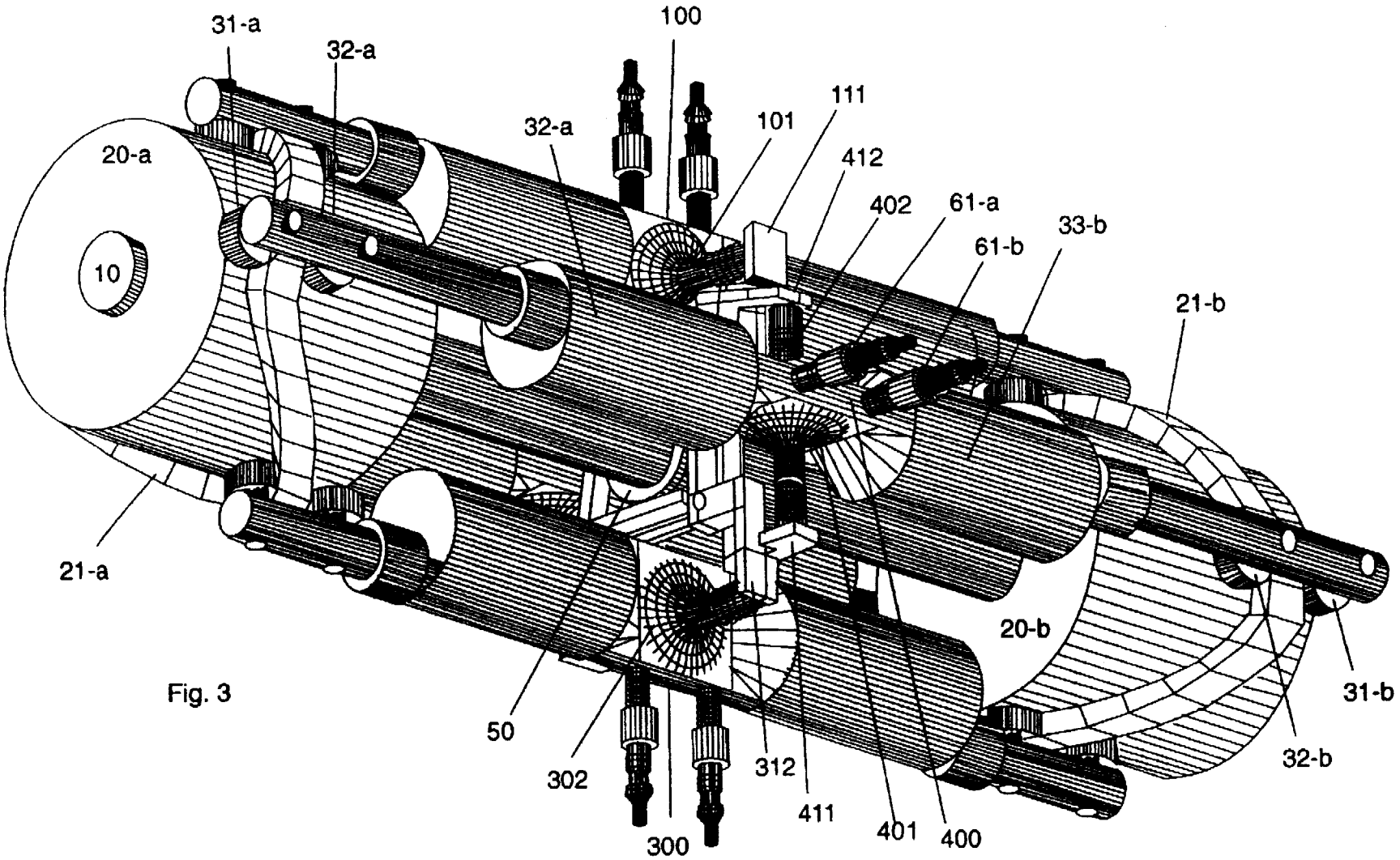
FIG. 3 shows a perspective view of the central combustion chamber engine assembly of the present invention in a preferred embodiment.

FIG. 3 shows a perspective view of the central combustion chamber engine assembly of the present invention in a preferred embodiment. As has already been mentioned, one of the characteristics of the central combustion chamber motor (CCCM) assembly is that the pistons act axially in opposed direction in such a conformation that it induces the movement of the main engine shaft (10) through the circular support (20-*a*) and (20-*b*), which, in turn, integrally moves the already described assembly of cams (intake cam is showed) (50), and the assembly of intake and exhaust valves for each combustion chamber. Moreover, as can be observed, in this engine embodiment there is no part or component that modifies the rotation ratios, remaining said rotation in four strokes without the need for toothed movement transmission means as is the case in conventional engines.

It can be observed also in such FIG. 3, the corresponding flanges or radial guides (21-*a*) and (21-*b*) which are superficially distributed in the radial support, through which the corresponding sliding means (31-*a*), (32-*a*), (31-*b*) and (32-*b*) are located in the distant end of each of the piston assembly and its corresponding combustion chamber (400), conveniently connected to said assemblies.

It must be observed that for each one of the piston assemblies, for example the two pistons (30-*a*) and (30-*b*), corresponds the sealed expansion housings, chambers or cylinders (33- *a*) and (33-*b*), through one of the so-called central combustion chamber (400) in which ignition means or spark plugs (61-*a*) and (61-*b*) are located, housed in the available spaces of said chamber.

According to the tests carried out, it is possible to determine that the symmetry which is conserved in the spirit of the present invention also permits that the expansion with regard to the ignition point offers a good fuel burning condition and expansion, achieving lower heat losses through radiations in the cylinder structure itself. Moreover it also permits to achieve a better fuel yield and optimum characteristics with regard to the emission of pollutant. This permits the simplification of the cooling and lubrication systems, among which the use of air can be mentioned as a cooling option. Note also that the disipative area of the expansion cylinders is greatly increased with respect to the conventional configuration.

The FIG. 3 shows the embodiment of the radial path in high relief type, however, it is also important to note that because of the design of the radial path of the cylinder sliding means, either of high or low relief types, internally or externally distributed on the circular support, it is possible to globally achieve a good efficiency, high compression ratio and low weight of the whole assembly.

In FIG. 3 the combustion chambers of the CCCM (100, 200, 300, 400) can be observed from different angles. Said chambers are located at the center of the opposing pistons, have a different geometry from the expansion cylinder and are defined mainly by the valve's parallel faces (101, 102, 201, 202, 301, 302, 401, 402). Said valves are positioned to move perpendicular to the main shaft (10) and perpendicular to a radial axis which can be visualized which goes from the central axis of the main shaft (10) to the center of the combustion chambers (100, 200, 300 400). The center of the central combustion chambers have opposing faces that are nearly flat and the upper portion of each cylinder converges into a smaller diameter leading into the combustion chamber. The diameter of the valves are approximately equal to the piston's diameter, as can be observed in FIG. 1.

In the free areas of the combustion chambers (100, 200, 300 and 400), there are spaces wide enough to locate the spark plugs or ignition means (61-*a*) and (62-*b*), which can be one or several. Said spaces can be conveniently used to locate sensors, additional spark plugs and fuel injectors, among other devices, according to the engine requirements and to insure the performance of said engine. Other valve elevator configurations, spark plugs with various orientations and configurations of the combustion chambers can be conveniently applied in order to make full use of the available space.

All these embodiments, and others that can be deduced from them and from the present description shall be considered within the spirit of the central combustion chamber engine assembly of the present invention.

According to one of the preferred embodiments of the present invention, a central combustion chamber engine of about 1600 cm3 was built. The compression ratio obtained from the design was 8.5:1, with the appropriate piston dimensions, piston traveling distance and valve diameter. One of the applied embodiments was that the piston heads had at least the same structural and dimensional configuration as the combustion chamber in order to achieve the desired compression ratios as exemplified in FIG. 1.

The use of two large combustion valves for the combustion chamber offers to the central combustion chamber motor (CCCM) good volumetric efficiencies, which can be modified as well as the compression ratios with various geometrys of the expansion cylinder, all of which are included within the spirit of the present invention. Moreover, and within said spirit of the invention, technical elements applied to conventional engines such as turbocharging systems, electronic injection and resonating tubes, among others, can be applied to optimize the performance of the engine.

There can also be engine embodiments with good performance characteristics from 1 to 4, and even up to 6 combustion chambers, following the suggested pathways. However, through the corresponding adaptations in the pathways of the guides and the configuration of the combustion chambers, valve and cam assemblies, it is possible to incorporate larger numbers of combustion chambers, without representing an inventive concept different from the one proposed here.

It has been demonstrated through the previous description of the invention in its various embodiments, and the by the perspective view of FIG. 3, that this engine present considerable advantages compared to conventional engine designs, specially with regard to the simplification of its design and construction, being thus remarkably less expensive than the traditional engines. Moreover, the structural characteristics of the motor assembly permit a better functional operating performance, in such a way that its symmetry allows a more adequate fuel combustion, with a rotary balance without variations.

Through the simple addition of two cams (not showed) it is possible to open and close the intake and exhaust valves to convert the assembly of the present invention into an air compression system, or to use said configuration as compressed air engine.

According to the above mentioned aspects, and according to what has been said in the description of the present invention in one of is preferred embodiments, it shall be considered that the modification with regard to structural and functional characteristics will respond to the spirit of the invention as it has been presented and will thus be within the scope of the following:

I claim:

1. A central combustion chamber engine comprising:

an assembly formed by a main shaft;

circular means connected to the longitudinal ends of said shaft having radial guides;

axially opposing pistons connected to the circular means;

assemblies of valves for the intake, sealing and exhaust of combustion gases actioned by a cam assembly; and central combustion chambers with corresponding ignition means and sealed expansion chambers wherein lateral sides of said combustion chambers are conformed mainly by the valve's parallel faces and the head of the pistons.

2. The central combustion chamber engine of claim 1, wherein said valves for the intake, sealing and exhaust of combustion gases are positioned for movement perpendicular to the main shaft and to a radial axis between the central axis of the main shaft and the center of the combustion chamber.

3. The central combustion chamber engine of one of claims 1 or 2, wherein the diameter of said valves for the intake, sealing and exhaust of combustion gases are approximately equal to the piston's diameter.

4. The central combustion chamber engine of claim 1, wherein an upper portion of each cylinder converges into a smaller diameter leading into the central combustion chamber.

5. The central combustion chamber engine of claim 3, wherein an upper portion of each cylinder converges into a smaller diameter leading into the central combustion chamber.

6. The central combustion chamber engine of claim 1, wherein the intake stroke is longer than the other strokes.

7. The central combustion chamber engine of claim 3, wherein the intake stroke is longer than the other strokes.

8. The central combustion chamber engine of claim 1, wherein the main shaft receives impulses of approximately sixty-six degrees.

9. The central combustion chamber engine of claim 1 having a plurality of central combustion chambers having said axially opposing pistons.

10. The central combustion chamber of claim 1, with additional cams to close the valves in a given combustion chamber when the pistons are moving toward said combustion chamber and open the valves in said combustion chamber when the pistons are moving away from said combustion chamber and whereby the main axle shaft is driven to convert the engine into an air compression system and conversion of compressed air into movement.

* * * * *